United States Patent [19]

Mauleon et al.

[11] Patent Number: 4,818,372

[45] Date of Patent: Apr. 4, 1989

[54] PROCESS AND APPARATUS FOR THE CATALYTIC CRACKING OF HYDROCARBON FEEDSTOCKS WITH REACTION-TEMPERATURE CONTROL

[75] Inventors: Jean-Louis Mauleon, Marly-le-Roi; Francois Ville, Paris; Jean-Bernard Sigaud, Vaucresson, all of France

[73] Assignee: Compagnie de Raffinage et de Distribution Total France, Paris Cedex, France

[21] Appl. No.: 111,115

[22] Filed: Oct. 20, 1987

Related U.S. Application Data

[63] Continuation of Ser. No. 884,015, Jul. 10, 1986, abandoned.

[30] Foreign Application Priority Data

Jul. 10, 1985 [FR] France ..... 85 10569

[51] Int. Cl.[4] ..... C10G 37/02

[52] U.S. Cl. ..... 208/113; 208/DIG. 1; 208/157

[58] Field of Search ..... 208/156, 157, 159, 155, 208/164, 166, 113, DIG. 1; 422/140, 142, 151

[56] References Cited

U.S. PATENT DOCUMENTS

| | | | |
|---|---|---|---|
| 2,685,498 | 8/1954 | Dickinson | 208/159 |
| 3,053,753 | 9/1962 | Slyngstad et al. | 208/78 |
| 3,617,497 | 11/1971 | Bryson et al. | 208/157 |
| 3,692,667 | 9/1972 | McKinney et al. | 208/120 |
| 3,886,060 | 5/1975 | Owen | 208/155 X |
| 3,894,936 | 7/1975 | Owen | 208/78 |
| 3,896,024 | 7/1975 | Nace | 208/155 X |
| 4,026,789 | 5/1977 | James | 208/DIG. 1 |
| 4,093,535 | 6/1978 | Schwartz | 208/DIG. 1 |
| 4,283,273 | 8/1981 | Owen | 208/113 |
| 4,411,773 | 10/1983 | Gross | 208/164 |
| 4,422,925 | 12/1983 | Williams et al. | 208/156 X |
| 4,427,537 | 1/1984 | Dean et al. | 422/140 X |
| 4,427,538 | 1/1984 | Bartnolic | 208/157 X |
| 4,437,977 | 3/1984 | Funk | 208/DIG. 1 |
| 4,450,241 | 5/1984 | Hettinger, Jr. et al. | 208/113 X |

FOREIGN PATENT DOCUMENTS

| | | |
|---|---|---|
| 0101553 | 2/1984 | European Pat. Off. . |
| 0139391 | 5/1985 | European Pat. Off. . |

*Primary Examiner*—Glenn Caldarola

*Attorney, Agent, or Firm*—A. Thomas S. Safford

[57] ABSTRACT

An apparatus for the catalytic cracking of hydrocarbon feedstocks with reaction temperature control is provided which includes an upward-flow or downward-flow cracking column, means for feeding said column under pressure with a hydrocarbon feedstock and with particles of a regenerated cracking catalyst, at least one means for injection of an auxiliary fluid downstream of the zone in said column where the hydrocarbon feedstock and the regenerated catalyst particles are contacted with each other, to reduce the temperature of the reaction zone situated directly downstream thereof, means for separating the products of the cracked feedstock and the spent catalyst particles, at least one stripping means, at least one unit for regeneration of the catalyst by combustion of the coke deposited thereon and means for recycling the regenerated catalyst to said feeding means.

16 Claims, 2 Drawing Sheets

PROCESS AND APPARATUS FOR THE CATALYTIC CRACKING OF HYDROCARBON FEEDSTOCKS WITH REACTION-TEMPERATURE CONTROL

This application is a continuation of application Ser. No. 884,015, filed July 10, 1986, abandoned.

The present invention relates to the catalytic cracking of hydrocarbon feedstocks in a fluidized bed. More particularly , it has as its object a process and an apparatus for such catalytic cracking applied to heavy hydrocarbons; achieved by independent control of the catalytic reaction temperature by quenching of the initial thermal cracking products.

As is known, in the so-called fluid catalytic cracking (FCC) process the hydrocarbon feedstock is completely vaporized by being contacted at high temperature with an appropriate cracking catalyst that is kept in suspension. After the desired molecular-weight range has been attained by cracking, with a corresponding lowering of the boiling points, the catalyst is rapidly separated from the products obtained.

In practice, the catalyst of the FCC process and the feedstock to be treated are contacted with each other at the base of a reactor consisting of a column known as a "feedstock elevator", to which those skilled in the art frequently refer by the English term "riser". A chamber that is concentric with the elevator is disposed at the top of the column. In the upper part of the chamber and above the elevator, there is located a ballistic separating system for recovery of the catalyst entrained by the vapors. Cyclone systems are generally used. The feedstock is discharged at the top of the chamber while the catalyst particles which have been deactivated by the deposition of coke are collected at the bottom of the chamber and there come in contact with a stripping fluid such as steam, injected at the bottom of the chamber, before being passed to a regenerator where the coke is burned off to restore their activity. Air for combustion is injected at the base of the regenerator while in the upper part of the latter cyclones are provided for the separation of the combustion gas from the entrained particles of regenerated catalyst. The latter is discharged in the lower part of the regenerator and recycled to the base of the elevator or rise, where the feedstock is usually injected at a temperature ranging from 80° C. to 400° C. and a pressure ranging from $0.7\times10^5$ to $3.5\times10^5$ relative Pascals.

The FCC process is, of course, carried out so that the cracking unit is in thermal balance, all of the heat required being supplied by the combustion of the coke deposited on the catalyst particles in the course of the cracking reaction. In other words, the supply of hot regenerated catalyst and the injection temperature of the feedstock to be cracked should be such that the unit is able to meet the various thermal requirements of the reactor section, more particularly:

Vaporization of the feedstock.

Heat input required by the reactions involved, which overall are endothermic.

Heat losses of the unit.

The two parameters "feedstock preheating temperature" and "regenerated-catalyst circulation" are therefore adjusted to set the reaction temperature throughout the reaction zone, and particularly at the outlet of the riser.

Alternatively, the catalyst may be introduced with the feedstock at the top of an essentially downflow reaction column or "dropper", at the base of which the spent catalyst is recovered, stripped, and sent to the regenerator.

However, the latest developments in the area of catalytic cracking have permitted the problem of injecting heavy petroleum feedstocks into catalytic cracking units to be solved only partly.

As is known, the higher the boiling point of a petroleum feedstock is, the more compounds the latter contains which are of hig molecular weight and rich in metals and thus are precursors of coke. These compounds, which include the asphaltenes, are of a cyclic or polycylic nature and have the peculiarity of being difficult to vaporize under the unusal injection conditions, and hence tend to form large coke depostis when they are contacted with catalyst particles to bring about the catalytic cracking reaction.

A first solution has therefore been proposed (U.S. Pat. No. 4,427,537) according to which heavy petroleum feedstocks containing in particular sizable quantities of asphaltenes could be cracked by improving their atomization in the zone of catalyst injection so as to produce, upon their being contacted with the catalyst particles, a sufficient thermal shock to permit thermal cracking of the molecules of high molecular weight. The thermal breakdown of these molecules into smaller molecules then permits the latter to be recracked catalytically in the gas phase when contacted with the catalyst particles.

It has thus been possible to treat heavy petroleum feedstocks, characterized in that at least 10 percent of their weight has a boiling point about 500° C., in catalytic cracking units through an increase in the temperature in the zone of injection of the catalyst and of the feedstock to be cracked (the "mixing zone") and by good atomization of the feedstock in that zone. However, the nonuniformity of the temperatures which results from such injection has made it necessary to develop reactors with short contact times to prevent overcracking or side reactions, such as polymerization reactions of the cracked products, and the production of an excess of gases that are difficult to upgrade.

In pursuing work on the catalytic cracking of heavy petroleum feedstocks, we have found that this first solution was only a partial solution of the problem of cracking heavy feedstocks that are particularly difficult to upgrade, such as those of which 10 weight percent has a boiling point above 500° C., since so much heat was required for the thermal cracking of the heavy molecules that the reaction rate, which is tied to the mixing temperature in the zone of injection of the feedstock to be cracked, imposed a limit of just a few seconds on the contact time, which rendered control of the reaction conditions by the means available at present very difficult.

However, we have determined that the cracking of heavy feedstocks can be effected in a simple and efficient manner by providing for proper regulation of the temperature in the reaction zone whereby:

a maximum thermal shock is produced upon injection during a period that is very short but long enough to permit thermal conversin of the molecules of high molecular weight, particularly the asphaltenes contained in the feedstock, with improved vaporization of the molecules which are to be cracked catalytically, whereupon the temperature of the desired catalytic reaction is maintained and remains independent of the temperature resulting from the injection of the catalyst and of the feedstock to be cracked, by introducing downstream of the feedstock injection zone an auxiliary fluid under such feedrate, temperature and pressure conditions that the introduction of this fluid permits the catalytic cracking reaction to proceed under conditions which are milder and independent of the mixing temperature.

Such regulation offers a dual advantage:

On the one hand, the substantial increase in the mixing temperature in the zone of injection of the heavy feedstock over the catalyst makes possible better vaporization of the feedstock and instantaneous thermal cracking of the heaviest compounds, which reduces the formation of coke on the catalyst particles mainly because compounds having a high boiling point or a basic character (nitrogenated aromatic compounds, condensed aromatic hydrocarbons, etc.) have a tendency to become adsorbed on and to neutralize certain acid sites on the catalyst, and, on the other hand, if thermal cracking of the heaviest molecules occurs practically instantaneously at high temperature, the lighter compounds, whether originating in the feedstock itself or from the thermal cracking reaction, should be cracked catalytically, by contact with the active sites of the catalyst particles in the course of a slower reaction whose optimum temperature is not necessarily the temperature resulting from the heavy feedstock injection conditions referred to above.

Temperature regulation practiced in accordance with the invention thus make it possible to control the duration of the contact between the molecules to be cracked and the catalyst and thus to prevent excessive prolongation of the thermal cracking which produces coke and light gases as well as side reactions due to an inappropriate catalytic cracking temperature.

One aim of the present invention therefore is to contact the feedstock with the catalyst, in a process for the catalytic cracking of a hydrocarbon feedstock in a fluidized bed, at an elevated temperature that is apt to prevent the deposition of coke on the catalyst and to optimally promote catalytic cracking of the feedstock.

Another aim of the invention is to control the duration of the contact between catalyst and feedstock at that elevated temperature with a view to minimizing side reactions or limiting the thermal cracking which may occur.

One embodiment of the invention therefore is a process for the catalytic cracking in a dilute fluidized bed, with short contact times of a heavy hydrocarbon feedstock of which more than 10 percent by weight has a boiling point above 500° C., said process comprising a contacting step with upward or downward flow in a column, under cracking conditions, of the feedstock and of particles of a cracking catalyst, a step of separation of the spent catalyst and the cracked feedstock downstream of the zone of feedstock injection, with at least one step of stripping the spent catalyst by means of a fluid, followed by a step of regeneration of the catalyst under conditions of combustion of the coke deposited thereon, and finally a step of recycling the regenerated catalyst to the inlet of the column. The process is further characterized in that the regenerated catalyst is injected into the column under such conditions that the equilbrium temperature resulting from mixing the vaporized feedstock and the catalyst is at least above 500° C. and at least 40° C. to 100° C. higher than the final reaction temperature at the outlet of the column, and in that an auxiliary fluid is injected downstream of the mixing zone but ahead of the separating step under such conditions that the injection of the auxiliary fluid permits the catalytic cracking reaction to proceed under conditions which are milder and independent of the mixing temperature.

The fluid injected may be a liquid or a gas and, in particular, water, steam, or any hydrocarbon that is vaporizable under the conditions of injection, and more particularly the gas oils from coking or from visbreaking, catalytic cycle oils, heavy aromatic solvents as well as certain deasphalted fractions extracted with a heavy solvent.

The injection of this fluid will thus have a selective quenching effect on the reaction mixture formed by the feedstock and the catalyst particles, and the rate of injection of the fluid should be such as to permit regulation under optimum conditions of the temperature of the catalytic cracking reaction without interfering with the subsequent stripping of the spent catalyst and without entrainment by the catalyst particles of condensation from the heaviest hydrocarbons present, which would result in increased deposition of coke on the catalyst. In practice, the conditions of injection of the fluid will be such that the injection produces an instantaneous reduction of the temperature of the reaction mixture on the order of from 10° C., to 70° C., which, at the final constant reaction temperature, will result in a substantially equivalent increase in the mixing temperature of feedstock to be cracked and regenerated catalyst particles.

In practice, the vaporization of the feedstock and the initial cracking reaction of the heaviest compounds being virtually instantaneous, the quenching effected by means of the auxiliary fluid will take place less than a second, and preferably less than half a second, after the injection of the feedstock being cracked.

As will be explained in greater detail further on, the process of the invention can be carried out either in an upward-flow cracking column (an elevator, also known as "riser") or in a downflow column or "dropper".

An important advantage of the process of the invention is that it permits the regeneration temperature of the catalyst to be limited owing to a reduced coke deposit, and further permits the conversion of heavy feedstocks which normally are excluded in the fluidized-bed catalytic cracking process.

It is thus possible to maintain, at the entrance to the reaction zone, the recycle flowrate of the catalyst and the ratio C/O between the mass of the catalyst (C) and the mass of the feedstock to be cracked (O) at the desired values to assure rapid and uniform vaporization of the feedstock approaching flash conditions and to obtain optimum conversion of the products of the feedstock, by catalytic cracking, to desired products.

To this end, the conditions of injection of the feedstock and of the catalyst will be such that the mixing temperature will be slightly higher than the feedstock vaporization temperature.

The conditions of injection of the auxiliary quenching fluid, and more particularly the feedrate, the temperature and the pressure, will of course have to be adjusted on the basis of the characteristics of the feedstock and of the catalyst as well as of the desired catalytic cracking reaction conditions and the temperature profile, meaning, in practice, on the basis of the desired mixing temperature and final reaction temperature.

In a preferred embodiment of the process of the invention, the injection of the auxiliary fluid into the cracking column is regulated so that the reaction temperature resulting from that injection is maintained at a predetermined and constant value that is sufficiently high for the stripping efficiency to undergo no substantial change.

The invention has a further embodiment an apparatus for the catalytic cracking of heavy hydrocarbon feedstocks of which more than 10 percent by weight has a boiling point above 500° C., which comprises an upward- or downward-flow cracking column, means for feeding said column under pressure with a hydrocarbon feedstock and with particles of a regenerated cracking catalyst, means for separating the products of the cracked feedstock and the spent catalyst particles, means for stripping the spent catalyst particles by at least one fluid, means for regeneration of the catalyst by combustion of the coke deposited thereon, and means for recycling the regenerated catalyst to said feeding means. The apparatus is further characterized in that it comprises, downstream of the zone in the column where the hydrocarbon feedstock and the regenerated catalyst particles are mixed, means for injection of an auxiliary fluid under such conditions of feedrate, temperature and pressure that the injection of this auxiliary fluid provides assurance that the feedstock will be catalytically cracked downstream under conditions which are milder and independent of the mixing temperature.

In a preferred embodiment, the apparatus comprises means for regulation of the feedrate, pressure and initial temperature of the auxiliary fluid in such a way that the final temperature of the catalytic cracking reaction is maintained at a predetermined and constant value in the reacton zone situated downstream.

The means for injection of an auxiliary fluid may advantageously be located in the reaction zone at a distance of between 0.1 and 0.8 times, and preferably between 0.1 and 0.5 times, the length of the reaction zone.

The injection means is advantageously formed by one or more injection devices of a type which is known to those skilled in the art and which permits the fluid to be distributed uniformly over the entire cross section of the reaction zone.

More particularly, when the regulating fluid is a liquid, the quantities required for regulation of the mixing temperature should be injected by means of an atomizing device which permits the fluid to be atomized, in a manner which is known to those skilled in the art, in the form of a very fine spray over the entire cross sectin of the reaction zone with a view to obtaining a heat transfer that is as nearly instantaneous as possible. In an industrial unit of the conventional type, the injection of from 20 to 150 liters of liquid water per cubic meter of feedstock being treated will permit the temperature of the mixing zone situated upstream to be raised by about 10° C. to 70° C.

Moreover, when the injected fluid is a hydrocarbon such as a catalytic cycle oil, the feedrate required to obtain the same temperature increase will be from 100 to 700 liters of hydrocarbon per cubic meter of feedstock being treated.

The invention will now be described in greater detail with reference to the accompanying diagrammatic drawings, wherein:

BRIEF DESCRIPTION OF THE DRAWINGS

In FIG. 1, the regenerated catalyst is injected through a pipe 1 at the base of an upward-flow column or riser 2, a carrier gas being injected at 3. The hydrocarbon feedstock to be treated is injected at injection means 4 at the base of the column, and the hydrocarbons and the catalyst particles are contacted with one another in the column 2, directly downstream of the point of injection of the feedstock. The temperature of the mixture of catalyst and vaporized feedstock ranges from about 500° C. to 650° C., depending on the nature of the feedstock and on the objectives of the desired conversion.

Figure 1:
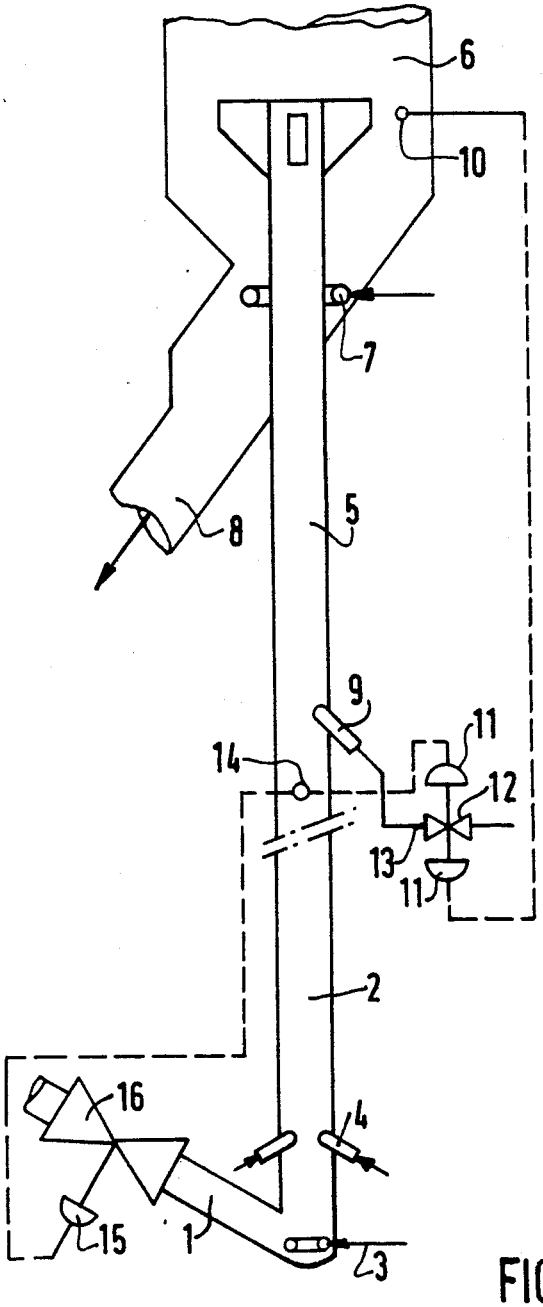
FIG. 1 illustrates a preferred embodiment of the process of the invention utilizing a fluidized-bed catalytic cracking unit with an upward-flow column or "riser"

At the top of column 2, a chamber 6 is provided for the separation of the cracked products and the spent catalyst particles. At the bottom of chamber 6 there are disposed injectors 7 for a stripping fluid, usually steam, which is acting countercurrently to the separated catalyst particles. At the bottom of chamber 6, the catalyst particles pass through pipe 8 to a second stripping device or to a regenerator (not shown), while the cracked products are discharged at the top (not shown) of chamber 6.

In accordance with the invention, an auxiliary fluid for the quenching of the products of cracking is injected at injection means 9 into an upper section 5 of the column 2 downstream of the zone of contact between catalyst particles and vaporized feedstock. This auxiliary fluid (water, steam, hydrocarbons, etc.) is injected at such a feedrate that it will lower the temperature of the mixture by 10° C. to 70° C., depending on the desired result, for the purpose of optimizing the catalytic cracking reactions of the feedstock. The final temperature of the reaction zone so cooled may be of the order of 500° C., for example, but should be above the dew point of the heaviest hydrocarbons present.

To this end, a temperature sensor 10 is provided inside the chamber 6 for measuring the temperature therein and optionally for actuating a valve 12 controlling the feedrate of the auxiliary fluid in line 13 supplying the injection means 9 so that the temperature in chamber 6 is maintained above a set temperature appropriate to the type of feedstock being treated. A further temperature sensor 14, located in column 2 upstream of the injection means 9 for the auxiliary fluid, that is, in the zone where the feedstock is contacted with the catalyst particles, controls both a valve 16 permitting manipulation of the rate of injection of regenerated catalyst into the column, and hence of the temperature in the contacting zone, and the valve 12 for regulation of the feedrate of the auxiliary fluid in the supply line 13 to the injection means 9.

Figure 2:
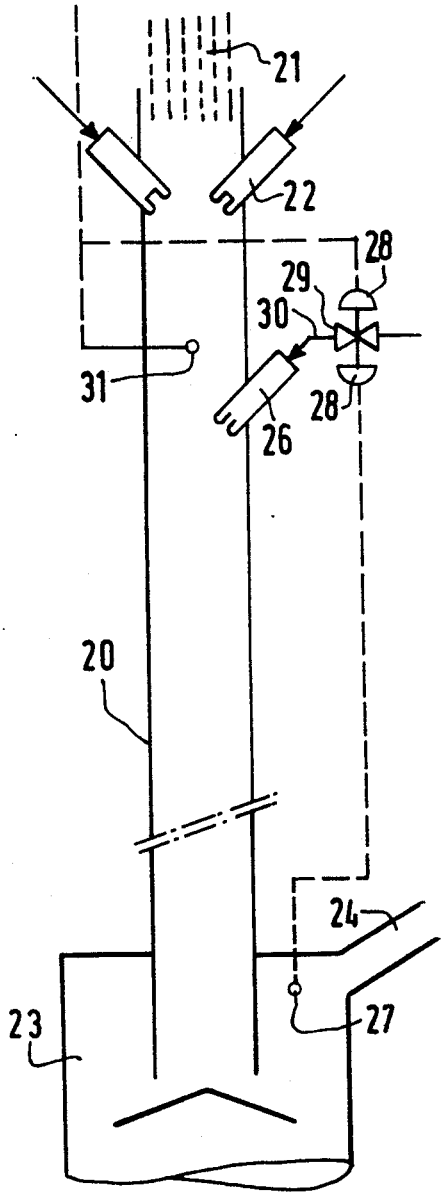
FIG. 2 illustrates an alternative embodiment of the process of the invention utilizing a cracking unit with a downflow column or "dropper"

In FIG. 2, the cracking column 20 is of the so-called dropper type, that is, the regenerated catalyst particles 21 are injected into the upper part of column 20 and drop therein by gravity. The feedstock to be cracked is likewise introduced into the upper part of the column at 22. A chamber 23 at the base of column 20 permits the separation and discharge of the effluents, that is, of the products of cracking, through a pipe 24 and of the spent catalyst particles toward the bottom of chamber 23, to be stripped and then conveyed to the regenerator.

In accordance with the invention, an auxiliary fluid for the quenching of the products of cracking is injected at injection means 26, downstream of the injection means 22 for the feedstock. The feedrate of that fluid is such, for a given mixing temperature, that it will lower the final reaction temperature by about 10° C. to 70° C. to permit the catalytic cracking reactions to proceed under optimal conditions.

As in the preceding case, a temperature sensor 27, located in front of the pipe 24, permits the rate of delivery of auxiliary fluid from the injection means 26 to be controlled by means of a valve 29, located in the supply pipe 30, in such a way that the temperature registered by temperature sensor 27 is at all times equal to or higher than a set temperature, the sensor permitting manipulation of the temperature of injection into the reaction zone and of the regulation of the rate of injection at injection means 26.

Figure 3:
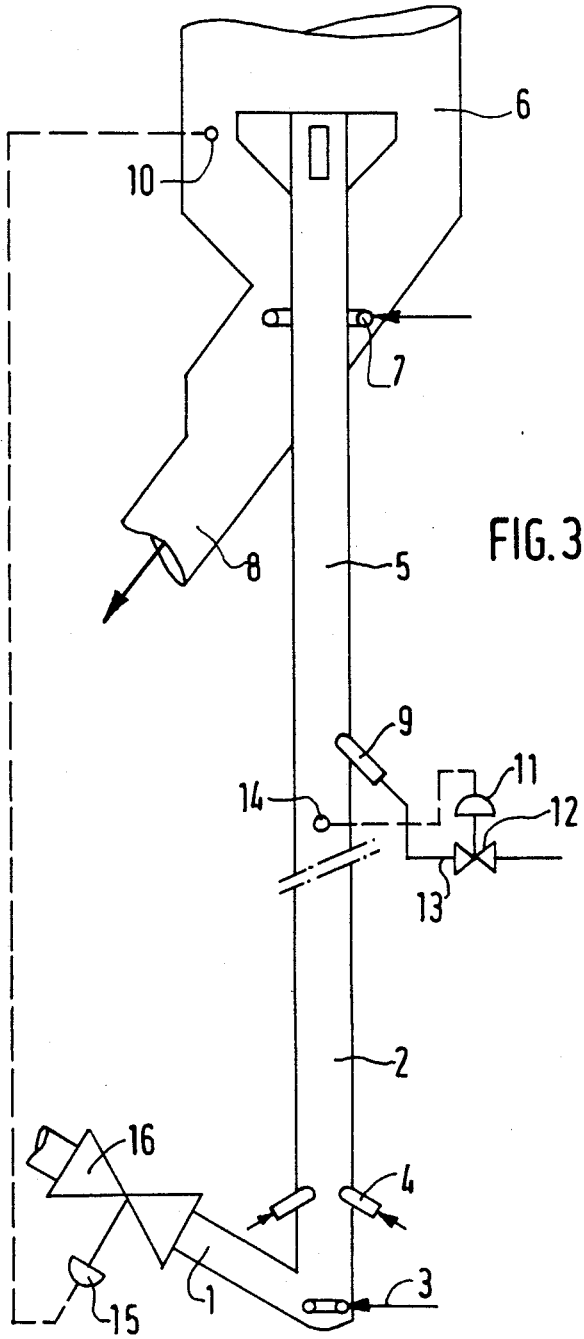
FIG. 3 illustrates a modification of FIG. 1 with a different mode of regulation of the process.

In FIG. 3, the cracking column 20 is again of the riser type, and the reference numerals designating the elements of the unit are the same as those in FIG. 1. FIG. 3 illustrates a simplified and particulaly advantageous mode of regulation in accordance with the present invention. As soon as auxiliary fluid is injected at injection means 9 or the volume injected is increased, the final temperature of the catalytic reaction, measured at temperature sensor 10, will tend to drop below the set value for the respective feedstock. Valve 16, acting on the feedrate of hot regenerated catalyst, immediately brings about an increase in the mixing temperature, which, allowing for the rate of injection at injection means 9, will permit the final cracking temperature to be again raised to the set value.

The two examples which follow will serve to illustrate the advantages of the process of the invention.

EXAMPLE 1

In a pilot cracking apparatus comprising a riser with short contact time and a two-stage catalyst regeneration system, as described in French patent application No. 2,574,422, a hydrodesulfurized residual feedstock having the following characteristics was cracked:

Gravity: 0.930
Sulfur (weight percent): 0.25
Conradson carbon (weight percent): 4.8
Nickel (ppm by weight): 10
Vanadium (ppm by weight): 24
Weight percent distilling above 500° C.: 52

For cracking, a commercial catalyst was used which comprised zeolites of high stability and a matrix suitable for the cracking of the heaviest hydrocarbon molecules under cracking conditions.

Two tests were run with the same feedstock, one under the usual cracking conditions, and the other with injection of a quenching fluid in the form of liquid water midway along the height of the riser.

The conditions of the two tests were as follows:

| | Usual cracking process | Process with injection of water |
|---|---|---|
| Temperature of feedstock (°C.) | 150 | 150 |
| Temperature of mixture after injection of feedstock (°C.) | 578 | 595 |

-continued

| | Usual cracking process | Process with injection of water |
|---|---|---|
| High-severity reaction temperature (°C.) before injection of water | 525 | 550 |
| Duration of contact with feedstock before quench (sec) | — | 1 |
| Temperature of mixture after injection of water (°C.) | 525 | 525 |
| Temperature of regenerated catalyst (°C.) | 810 | 757 |
| C/O ratio* | 4.6 | 6.7 |
| Conversion (percent by volume, liq.) | 72.8 | 77.9 |
| Coke (weight percent on catalyst) or delta coke | 1.50 | 1.09 |
| Hydrogen on coke (weight percent) | 7.65 | 6.55 |

*Ratio of mass of catalyst (C) to mass of feedstock (O) upon being contacted with each other at the entrance to the reaction zone.

The above table shows the advantage resulting from raising the initial cracking temperature to above 550° C. and from quenching the reaction products with water to reduce the temperature of the mixture to 525° C.

For an identical final cracking temperature (525° C.) and with an injection temperature of 595° C. as against 578° C., the hydrogen content of the coke is lower in the case of the process of the invention and the delta coke is slightly lower, which shows that the heavy fractions were effectively cracked and did not remain adsorbed on the spent catalyst.

It is apparent that with a lower spent-catalyst temperature and with less delta coke and a lower hydrogen content, it is possible to reduce the final catalyst regeneration temperature by about 53° C. This can be taken advantage of to increase either the C/O ratio (as in this example) or the temperature of the feedstock, which will result in considerably improved vaporization of the feedstock.

The beneficial effects obtained by the process of the invention can be summarized as follows:

Improved conversion and better selectivity for gasoline and distillate are obtained along with decreased production of dry gases resulting in a reduction of thermal cracking and of the effect of the nickel. Moreover, the more olefinic and less aromatic character of the products results in a better octane number and a better cetane number. Finally, the improved stability of the catalyst due to a lower regeneration temperature makes it possible to maintain the desired activity with lower replacement rate of the catalyst.

EXAMPLE 2

The same apparatus and the same cracking catalyst were used with a feedstock having the following characteristics:

Gravity: 0.954
Sulfur (weight percent): 0.95
Conradson carbon (weight percent): 8.2
Nickel (ppm by weight): 39
Vanadium (ppm by weight): 1
Weight percent distilling above 500° C.: 65

The auxiliary fluid this time was provided by recycling the cracking effluents having a boiling point between 340° C. and 460° C., about 0.2 sec after injection of the feedstock into the mixing zone.

The operating conditions were as follows:

Temperature of feedstock (°C.): 200
Temperature of mixture after injection of feedstock (°C.): 600

High-severity reaction temperature before injection of auxiliary fluid (°C.): 556
Quantity of auxiliary fluid injected (percent of feedstock): 40
Injection temperature of auxiliary fluid (°C.): 210
Duration of contact with feedstock before quench (sec): 0.2
Temperature of mixture after atomization of auxiliary fluid (°C.): 516
Final reaction temperature (°C.): 510
Temperature of regenerated catalyst (°C.): 790
C/O ratio: 5.6
Conversion (percent by volume, liq.): 76.8
Coke (weight percent on catalyst) or delta coke: 1.48

In this example, the heavy feedstock involved could not have been treated without resorting to the means adpoted in the present invention since at least 15 weight percent of the feedstock could not have been vaporized on the basis of the prior art, which would have resulted in the formation of coke beyond the limits within which the heat balance of the unit could have been satisfied. The mixing temperature was increased by about 40° C. to provide for complete vaporization and for the thermal-shock conditions required for the cracking of the heaviest compounds present in the feedstock, following which the atomization of a hydrocarbon in the reaction medium permitted the final temperature to be brought back to 510° C., thus assuring optimum conversion.

The process of the invention thus makes it possible to improve the performance of a cracking unit for a given hydrocarbon feedstock. It can be used to advantage for treating heavier and more severely contaminated feedstocks more effectively. Moreover, the process holds exceptional appeal for the treatment of nitrogenated feedstocks or feedstocks rich in polar compounds, such as resins or asphaltenes, where the pronounced presence of aromatic nitrogen is responsible for a spectacular drop in conversion. With a Nigerian KOLE residue, for example, the gain in conversion achieved with the process of the invention is of the order of 5.5 percent by volume. This is explained by the higher mixing temperature, which produces a favorable shift in the adsorption equilibrium of the aromatic nitrogen and thus minimizes the neutralization of certain acid sites on the catalyst.

What is claimed is:

1. A process for the catalytic cracking of heavy hydrocarbon feedstock of which more than 10 weight percent has a boiling point above 500° C., comprising the steps of:

contacting in an inlet zone the feedstock and hot active particles of a cracking catalyst in a dilute fluidized bed under thermal conditions sufficiently high to vaporize virtually instantaneously substantially all the feedstock and to enhance initial thermal cracking of the heaviest compounds contained in the feedstock;

maintaining a temperature moderated reaction zone by injecting an auxiliary fluid into the dilute fluidized bed downstream of the inlet zone wherein the feedstock and catalyst are mixed, but upstream of an outlet zone wherein the cracked feedstock and spent catalyst are separated, under conditions such that the injection of the auxiliary fluid produces a rapid reduction in the temperature of the mixed vaporized feedstock and active catalyst particles by from 10 C. to 70° C. in a time of less than one second after injection of the feedstock, thereby causing the subsequent downstream catalytic cracking reactions to proceed in the temperature moderated reaction zone under conditions more favorable for catalytic cracking which conditions are relatively milder and independent of the temperature resulting from the mixing of vaporized feedstock and active catalyst; said auxiliary fluid being a gas or being completely vaporizable under the conditions in said temperature moderated reaction zone while at least a substantial portion of said heavy hydrocarbon feedstock is substantially unvaporizable under the conditions in said temperature moderated reaction zone;

separating spent catalyst from the cracked feedstock in said outlet zone downstream of the temperature moderated zone;

stripping the spent catalyst;

regenerating the spent catalyst by combusting coke deposited thereon during the cracking step to produce a hot, active regenerated catalyst; and recycling the hot regenerated catalyst to said inlet zone for said contacting with the feedstock under conditions such that the temperature resulting from the mixing of the feedstock and catalyst is at least above 500° C. and is also at least from 40° to 100° C. higher than the final reaction temperature at said outlet zone.

2. The process of claim 1 wherein the auxiliary fluid is water.

3. The process of claim 2 wherein the water is injected in a quantity of between 20 and 150 liters per cubic meter of feedstock injected into the diluted fluidized bed.

4. The process of claim 1 wherein the auxiliary fluid is one selected from the group consisting of a gas oil, a catalytic cycle, a heavy aromatic solvent and a deasphalted fraction extracted with a heavy solvent.

5. The process of claim 1 wherein the auxilahydrocarbon is injected in a quantity of between 100 and 700 liters per cubic meter of feedstock injected into the dilute fluidized bed.

6. The process of claim 1 further comprised by regulating the feed rate of the auxiliary fluid such that the temperature of the reaction zone in the column downstream of the point of injection of the auxiliary fluid is maintained at a set value which is determined by the nature of the feedstock to be cracked, the type of catalyst used and the method of regeneration of the catalyst.

7. The process of claim 6 further comprised by regulating the feed rate of hot catalyst in response to changes in the set value of the temperature of the reaction zone downstream of the point of injection of the auxiliary fluid.

8. The process of claim 1 wherein the dilute fluidized bed is an upward-flow cracking column.

9. The process of claim 1 wherein the dilute fluidized bed is a downward-flow cracking column.

10. The process of claim 1 wherein the auxiliary fluid is injected uniformly over the entire cross-section of the dilute fluidized bed by means of a plurality of atomizing devices.

11. The process of claim 1 wherein means for injecting the auxiliary fluid are located at a point in the dilute fluidized bed such that the temperature reduction produced by the injection of the auxiliary fluid takes place less than half a second after injection of the feedstock.

12. The process according of claim 1 wherein the temperature resulting from the mixing of the feedstock to be cracked and the catalyst is in the range of from 500° C. to 650° C.

13. The process according to claim 1 wherein said heavy hydrocarbon feedstock comprises in significant amounts one or more high molecular weight petroleum compounds chosen from the group consisting of resins, asphaltenes, nitrogenated aromatic compounds, condensed aromatic hydrocarbons, cyclic and polycyclic hydrocarbons, and heavy residual fractions.

14. The process according to claim 4 wherein said heavy hydrocarbon feedstock comprises in significant amounts one or more high molecular weight petroleum compounds chosen from the group consisting of resins, asphaltenes, nitrogenated aromatic compounds, condensed aromatic hydrocarbons, cyclic and polycyclic hydrocarbons, and heavy residual fractions.

15. The process according to claim 7 wherein the temperature resulting from the mixing of the feedstock to be cracked and the catalyst is in the range of from 500° C. to 650° C.; and wherein the auxiliary fluid is injected uniformly over the entire cross-section of the dilute fluidized bed by means of a plurality of atomizing devices.

16. The process of claim 15, further comprising monitoring the temperature at the outlet zone, regulating the feed rate of hot catalyst to the inlet zone in reverse proportion to the outlet temperature monitored at the outlet zone to maintain said outlet temperature at a set value for said outlet zone, monitoring the mix temperature of the mixture of catalyst and feedstock in the inlet zone and regulating the feed rate of the auxiliary fluid injection in proportion to variations in the mix temperature of the mixture of catalyst and feedstock in the inlet zone to maintain said mix temperature at a set value for said inlet zone.

* * * * *